US010352111B2

(12) United States Patent
Logan et al.

(10) Patent No.: US 10,352,111 B2
(45) Date of Patent: Jul. 16, 2019

(54) DRILL COLLAR WITH INTEGRATED PROBE CENTRALIZER

(71) Applicant: Evolution Engineering Inc., Calgary (CA)

(72) Inventors: Aaron W. Logan, Calgary (CA); Justin C. Logan, Calgary (CA); Patrick R. Derkacz, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 1103 days.

(21) Appl. No.: 14/441,124

(22) PCT Filed: Nov. 6, 2013

(86) PCT No.: PCT/CA2013/050852

§ 371 (c)(1),
(2) Date: May 6, 2015

(87) PCT Pub. No.: WO2014/071522

PCT Pub. Date: May 15, 2014

(65) Prior Publication Data

US 2015/0267481 A1 Sep. 24, 2015

Related U.S. Application Data

(60) Provisional application No. 61/723,288, filed on Nov. 6, 2012.

(51) Int. Cl.
*E21B 17/10* (2006.01)
*E21B 47/01* (2012.01)
(Continued)

(52) U.S. Cl.
CPC ..... *E21B 17/1078* (2013.01); *E21B 7/04* (2013.01); *E21B 17/042* (2013.01); *E21B 17/16* (2013.01);
(Continued)

(58) Field of Classification Search
CPC ..... E21B 47/00; E21B 47/01; E21B 23/03
See application file for complete search history.

(56) References Cited

U.S. PATENT DOCUMENTS 3,149,490 A * 9/1964 Havlik ..... E21B 47/011 175/41
3,323,327 A 6/1967 Leathers et al.
(Continued)

FOREIGN PATENT DOCUMENTS

EP 1248896 B1 4/2006
WO 2006083764 A1 8/2006
(Continued)

*Primary Examiner* — D. Andrews
*Assistant Examiner* — Tara E Schimpf
(74) *Attorney, Agent, or Firm* — Oyen Wiggs Green & Mutala LLP

(57) ABSTRACT

An assembly for use in subsurface drilling includes a downhole probe supported in a drill string section by centralizing features that are integral with the drill string section. A bore wall of the drill string section is fluted to provide inward contact points that support the downhole probe. The downhole probe may be supported for substantially its entire length. A vibration damping and/or electrically insulating material may optionally be provided between the downhole probe and the drill string section.

56 Claims, 12 Drawing Sheets

(51) Int. Cl.

| | |
|---|---|
| ***E21B 17/16*** | (2006.01) |
| ***E21B 7/04*** | (2006.01) |
| ***E21B 17/042*** | (2006.01) |
| ***E21B 23/03*** | (2006.01) |
| ***E21B 47/12*** | (2012.01) |

(52) U.S. Cl.
CPC ..... *E21B 23/03* (2013.01); *E21B 47/011* (2013.01); *E21B 47/122* (2013.01)

(56) References Cited

U.S. PATENT DOCUMENTS

| | | | | |
|---|---|---|---|---|
| 3,466,597 | A * | 9/1969 | Richter, Jr. ..... | E21B 47/01 340/853.9 |
| 4,571,215 | A | 2/1986 | Hansen | |
| 4,684,946 | A | 8/1987 | Issenmann | |
| 4,938,299 | A | 7/1990 | Jelsma | |
| 5,236,048 | A | 8/1993 | Skinner et al. | |
| 5,247,990 | A | 9/1993 | Sudol et al. | |
| 5,474,132 | A | 12/1995 | Gallagher | |
| 5,520,246 | A * | 5/1996 | Van Steenwyk ..... | E21B 47/011 166/242.1 |
| 6,429,653 | B1 | 8/2002 | Kruspe et al. | |
| 6,446,736 | B1 | 9/2002 | Kruspe et al. | |
| 6,750,783 | B2 | 6/2004 | Rodney | |
| 6,761,230 | B2 | 7/2004 | Cross et al. | |
| 7,151,466 | B2 | 12/2006 | Gabelmann et al. | |
| 7,243,028 | B2 | 7/2007 | Young et al. | |
| 7,604,059 | B2 | 10/2009 | Thornton | |
| 8,020,634 | B2 | 9/2011 | Utter et al. | |
| 2005/0217898 | A1 * | 10/2005 | Clark ..... | E21B 17/07 175/56 |
| 2007/0235224 | A1 * | 10/2007 | Koger ..... | E21B 17/1007 175/40 |
| 2009/0023502 | A1 | 1/2009 | Koger et al. | |

FOREIGN PATENT DOCUMENTS

| | | | |
|---|---|---|---|
| WO | 2008116077 | A2 | 9/2008 |
| WO | 2012045698 | A1 | 4/2012 |
| WO | 2012082748 | A2 | 6/2012 |

* cited by examiner

DRILL COLLAR WITH INTEGRATED PROBE CENTRALIZER

REFERENCE TO RELATED APPLICATIONS

This application claims priority from U.S. Application No. 61/723,288 filed 6 Nov. 2012. For purposes of the United States, this application claims the benefit under 35 U.S.C. § 119 of U.S. Application No. 61/723,288 filed 6 Nov. 2012 and entitled DRILL COLLAR WITH INTEGRATED PROBE CENTRALIZER which is hereby incorporated herein by reference for all purposes.

TECHNICAL FIELD

The invention relates to subsurface drilling, more specifically to systems for supporting downhole probes. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at the surface.

Bottom hole assembly (BHA) is the name given to the equipment at the terminal end of a drill string. In addition to a drill bit a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars, pulsers and the like. The BHA is typically advanced into the wellbore by a string of metallic tubulars (drill pipe).

Modern drilling systems may include any of a wide range of electronics systems in the BHA or at other downhole locations. Such electronics may include sensors for collecting data of various kinds, controls for downhole equipment, signal processing systems, data telemetry systems etc. Supporting and protecting downhole electronics is important as a downhole electronics package may be subjected to high pressures (20,000 p.s.i. or more in some cases), along with severe shocks and vibrations.

There are references that describe various centralizers that may be useful for supporting a downhole electronics package centrally in a bore within a drill string. The following is a list of some such references: US2007/0235224; US2005/0217898; U.S. Pat. Nos. 6,429,653; 3,323,327; 4,571,215; 4,684,946; 4,938,299; 5,236,048; 5,247,990; 5,474,132; 5,520,246; 6,429,653; 6,446,736; 6,750,783; 7,151,466; 7,243,028; US2009/0023502; WO2006/083764; WO2008/116077; WO2012/045698; and WO2012/082748.

U.S. Pat. No. 5,520,246 issued May 28, 1996 discloses apparatus for protecting instrumentation placed within a drill string. The apparatus includes multiple elastomeric pads spaced about a longitudinal axis and protruding in directions radially to the axis. The pads are secured by fasteners.

US 2005/0217898 published Oct. 6, 2005 describes a drill collar for damping downhole vibration in the tool-housing region of a drill string. The collar comprises a hollow cylindrical sleeve having a longitudinal axis and an inner surface facing the longitudinal axis. Multiple elongate ribs are bonded to the inner surface and extend parallel to the longitudinal axis.

Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data allows for relatively more economical and more efficient drilling operations.

Various techniques have been used to transmit information from a location in a bore hole to the surface. These include transmitting information by generating vibrations in fluid in the bore hole (e.g. acoustic telemetry or mud pulse telemetry) and transmitting information by way of electromagnetic signals that propagate at least in part through the earth (EM telemetry). Other examples of telemetry systems use hardwired drill pipe or fibre optic cable or drill collar acoustic telemetry to carry data to the surface.

A typical arrangement for electromagnetic telemetry uses parts of the drill string as an antenna. The drill string may be divided into two conductive sections by including an insulating joint or connector (a "Gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. The electromagnetic signals may be detected at the surface, for example by measuring electrical potential differences between the drill string or a metal casing that extends into the ground and one or more ground rods. A challenge with EM telemetry is that the generated signals are significantly attenuated as they propagate to the surface. Further, the electrical power available to generate EM signals May be provided by batteries or another power source that has limited capacity. Therefore, it is desirable to provide a system in which EM signals are generated efficiently.

Design of the gap sub is an important factor in an EM telemetry system. The gap sub must provide electrical isolation between two parts of the drill string as well as withstand the extreme mechanical loading induced during drilling and the high differential pressures that occur between the center and exterior of the drill pipe. Drill string components are typically made from high strength, ductile metal alloys in order to handle the loading without failure. Most electrically-insulating materials suitable for electrically isolating different parts of a gap sub are weaker than metals (e.g. rubber, plastic, epoxy) or quite brittle (ceramics). This makes it difficult to design a gap sub that is both configured to provide efficient transmission of EM telemetry signals and has the mechanical properties required of a link in the drill string.

There remains a need for ways to support downhole probes, which may include electronics systems of a wide range of types at downhole locations in a way that provides at least some protection against mechanical shocks and vibrations and other downhole conditions. Some telemetry systems use electrical or other connections between a telemetry signal generator and a drill string component such as a gap sub. It would be desirable to provide systems for supporting downhole probes that facilitate such connections.

SUMMARY

The invention has a number of aspects. One aspect provides downhole apparatus that includes a downhole probe as may be used, for example in subsurface drilling. Other aspects of the invention provide downhole apparatus and systems that include centralizing features and associated methods.

One example aspect of the invention provides a downhole assembly comprising a drill string section having a bore extending longitudinally through the drill string section and a downhole probe located in the bore of the section. The drill string section comprises centralizing features extending inwardly from a wall of the bore. The centralizing features support the downhole probe in the bore. The centralizing features are arranged to provide passages for the flow of drilling fluid around an outside of the downhole probe between the centralizing features. The centralizing features are integral with the section. In some embodiments the section comprises a steel drill collar and the centralizing features are inwardly-projecting parts of the bore wall. The centralizing features may, for example, have the form of rounded lobes in transverse cross section. The centralizing features may have the form of ridges that extend longitudinally along a section of the bore. In some embodiments the features are configured as helical structures that extend along and around the bore.

Another aspect of the invention provides subsurface drilling methods. The methods comprise inserting a downhole probe into a drill string section. The drill string section comprises centralizing features extending inwardly from a wall of a bore of the drill string section. The centralizing features are integral with the drill string section. Inserting the probe comprises sliding the probe longitudinally into the drill string section between the centralizing features and then securing the probe against longitudinal movement relative to the drill string section. The method further comprises coupling the drill string section into a drill string; and lowering the probe into a borehole as drilling advances.

Further aspects of the invention and non-limiting example embodiments of the invention are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
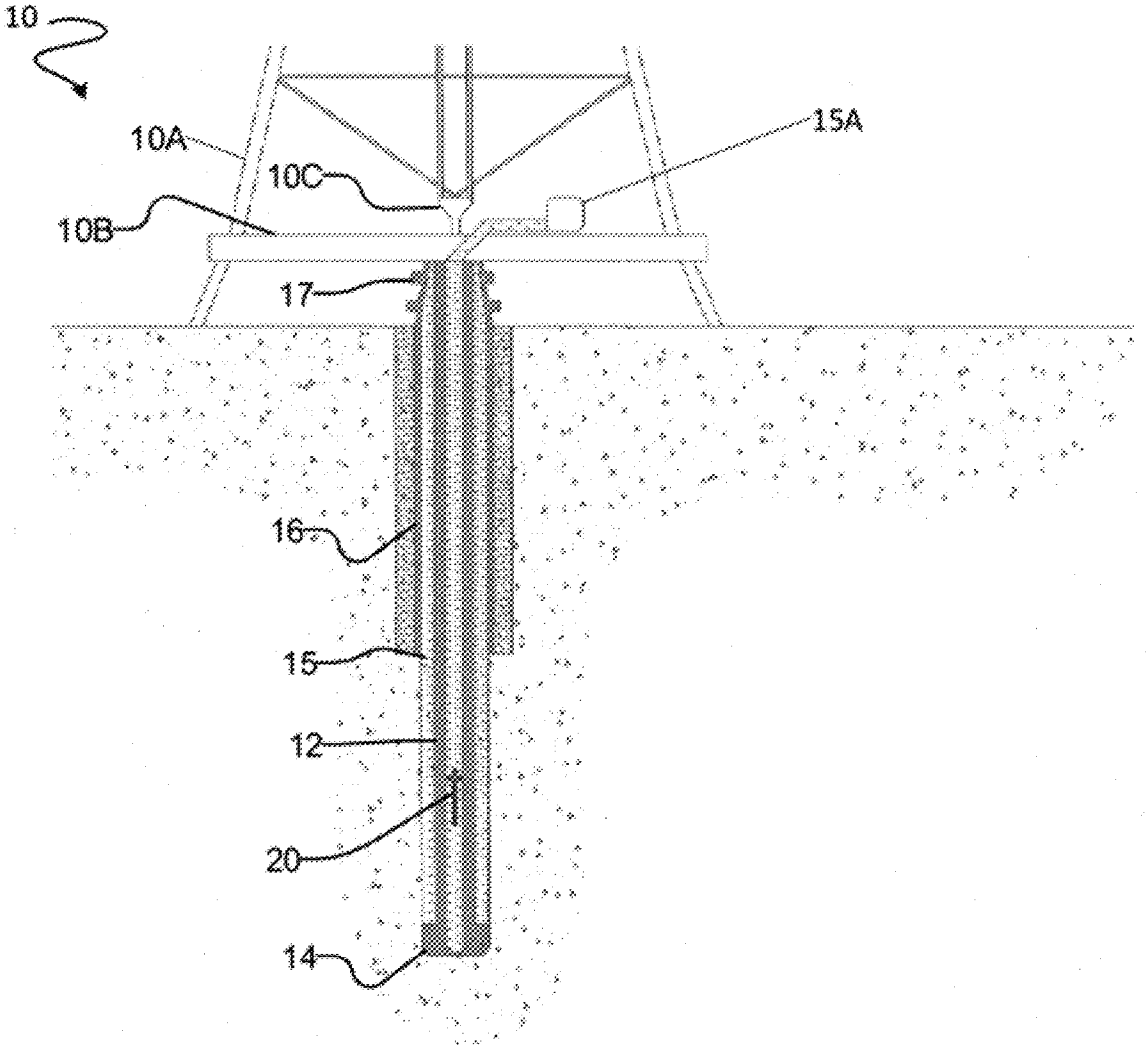
FIG. 1 is a schematic view of a drilling operation according to one embodiment of the invention.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped by a pump 15A through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Drill string 12 includes a downhole probe 20. Here the term 'probe' encompasses any active mechanical, electronic, and/or electromechanical system. A probe may provide any of a wide range of functions including, without limitation, data acquisition, sensing, data telemetry, control of downhole equipment, status monitoring for downhole equipment, collecting data by way of sensors that may include one or more of vibration sensors, magnetometers, nuclear particle detectors, electromagnetic detectors, acoustic detectors, and others, emitting signals, particles or fields for detection by other devices, etc. Some downhole probes are highly specialized and expensive. Downhole conditions can be harsh. Exposure to these harsh conditions, which can include high temperatures, vibrations, shocks, and immersion in various drilling fluids can shorten the lifespan of downhole probes.

The following description describes an electronics package 22 which is one example of a downhole probe. However, the probe is not limited to electronics packages and, in some embodiments, could comprise mechanical or other non-electronic systems. Electronics package 22 comprises a housing enclosing electric circuits and components providing desired functions.

The housing of electronics package 22 typically comprises an elongated cylindrical body that contains within it electronic systems or other active components of the downhole probe. The body may, for example, comprise a metal tube designed to withstand downhole conditions. The body may, for example, have a length in the range of 1 to 20 meters.

Downhole electronics package 22 may optionally include a telemetry system for communicating information to the surface in any suitable manner. In some example embodiments a telemetry system is an electromagnetic (EM) telemetry system however, where telemetry is provided, other modes of telemetry may be provided instead of or in addition to EM telemetry.

FIGS. 2, 2A, 4 and 4A show a downhole assembly 25 comprising an electronics package 22 supported within a bore 27 in a section 26 of drill string. Section 26 may, for example, comprise a drill collar, a gap sub or the like. Section 26 may comprise a single component or a number of components that are coupled together and are designed to allow section 26 to be disassembled into its component parts if desired. For example, section 26 may comprise a plurality of collars coupled together by threaded or other couplings.

Electronics package 22 is smaller in diameter than bore 27. Electronics package is centralized within bore 27 by features provided within the bore of section 26. FIGS. 2B, 2C, 5 and 5A show the downhole assembly 25 without an electronics package 22 to better show the centralizing features.

As shown in FIGS. 2B, 2C, 5 and 5A, section 26 is provided with centralizing features 28 that project radially-inwardly into bore 27. Features 28 are integral with the material of section 26. For example, where section 26 comprises a steel or other metal collar, features 28 may comprise inwardly-extending continuations of the material of the collar.

Centralizing features 28 are arranged to project inwardly far enough to support electronics package 22 (or any other downhole probe). Features 28 are circumferentially spaced apart around the bore wall of bore 27 such that electronics package 22 is supported against being displaced in any direction transverse to section 26.

Centralizing features 28 are dimensioned to accommodate the dimensions of an electronics package 22 to be supported. In some embodiments one or both of centralizing features 28 and/or the outer surface of electronics package 22 are coated with a damping layer of material. The damping layer may comprise a material that has a hardness less than that of the outer surfaces of electronics package 22 and features 28. Some example materials that may be used as a damping layer are materials such as plastic, thermoplastic, elastomers and rubber. In embodiments which provide a damping layer between the downhole probe and centralizing features 28 the thickness of such material layers is taken into account in dimensioning centralizing features 28 so as to provide a desired snug fit of the downhole probe between centralizing features 28. The damping layer may have a uniform thickness but this is not mandatory.

Figure 2:
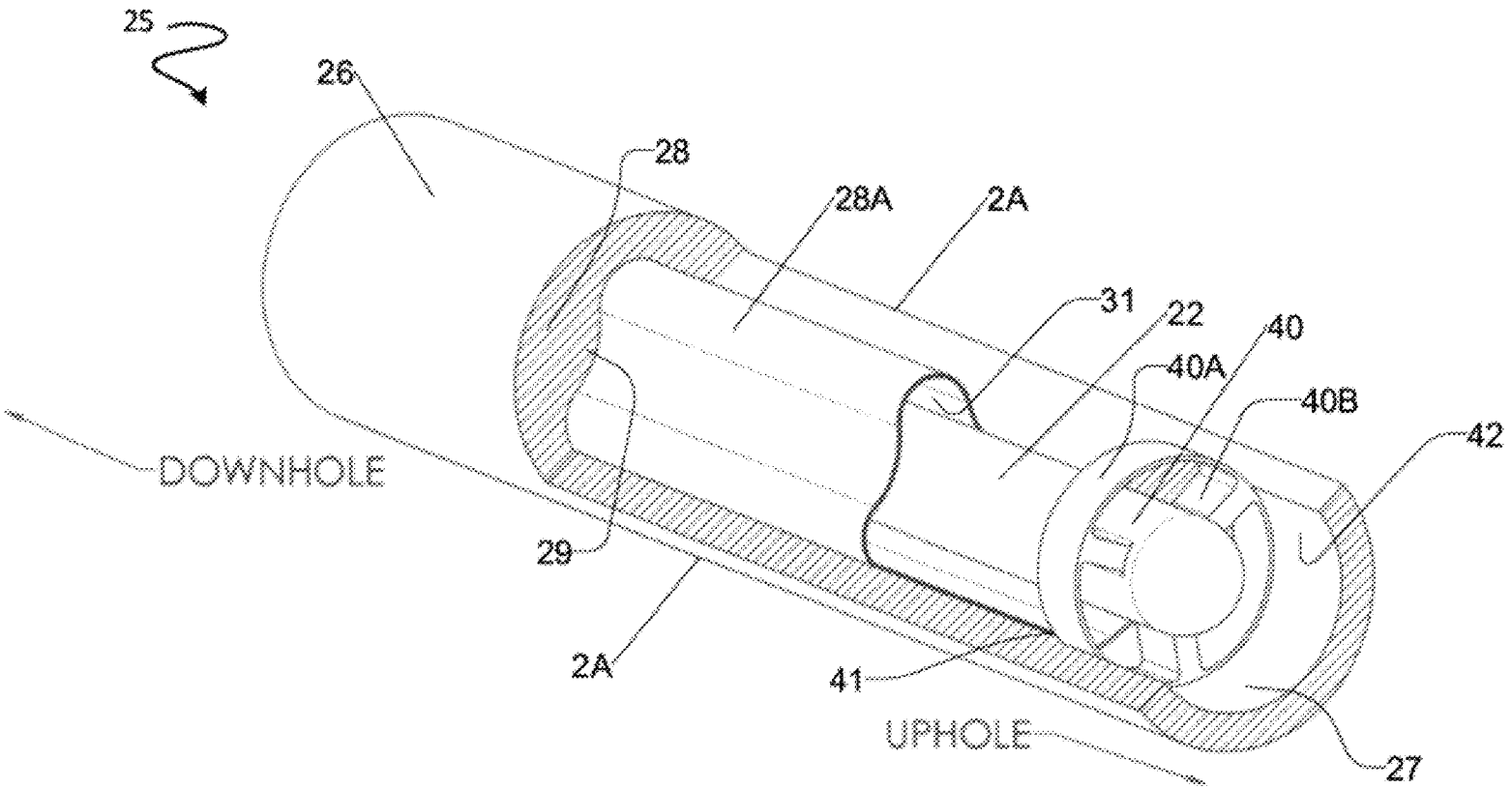
FIG. 2 is a perspective cutaway view of a downhole assembly containing an electronics package.
Figure 2A:
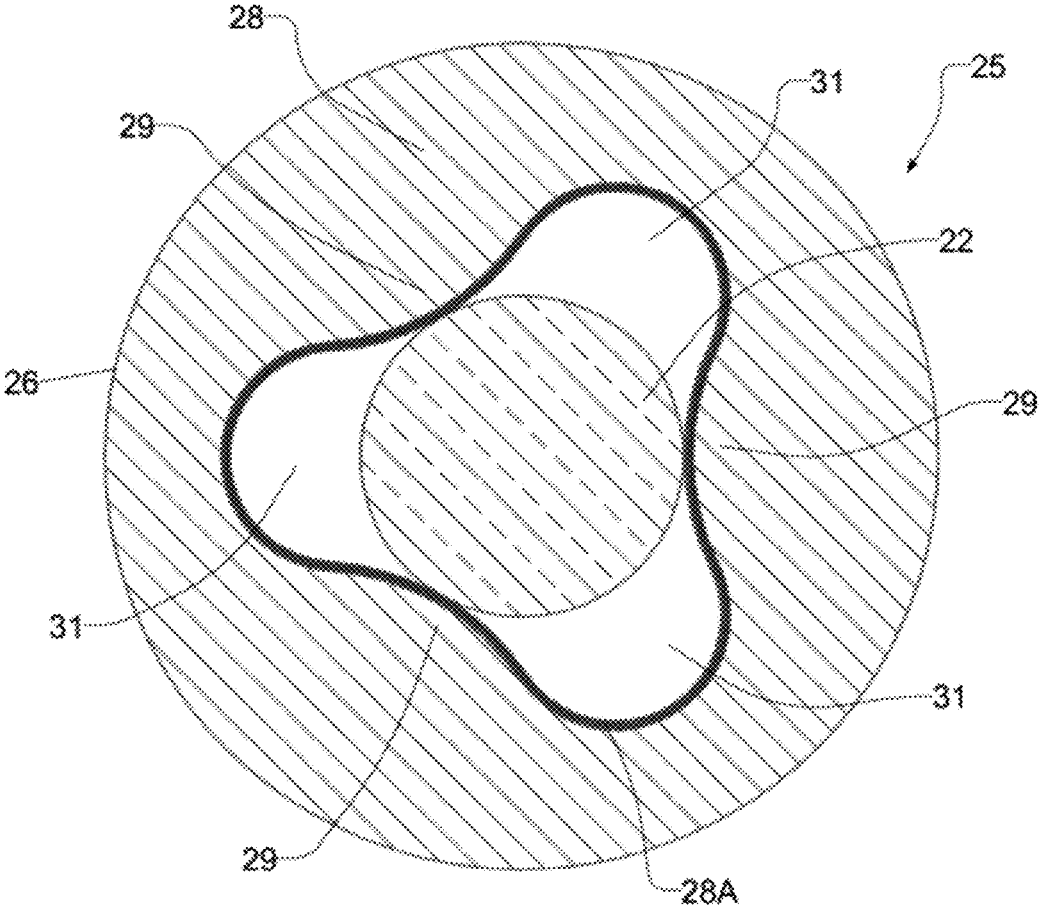
FIG. 2A is a view taken in section along the line 2A-2A of FIG. 2.
Figure 2B:
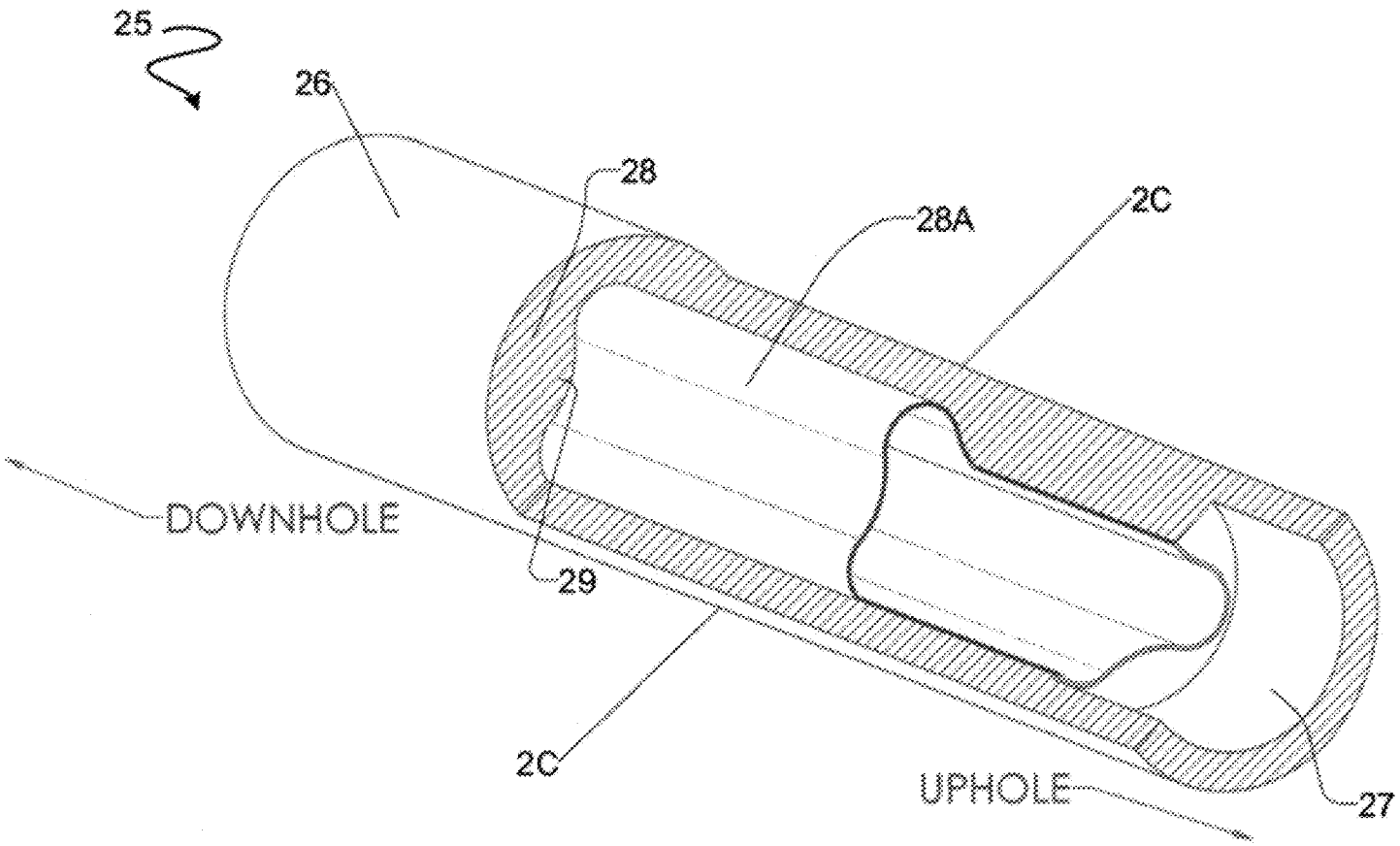
FIG. 2B is a perspective cutaway view of a downhole assembly not containing an electronics package.
Figure 2C:
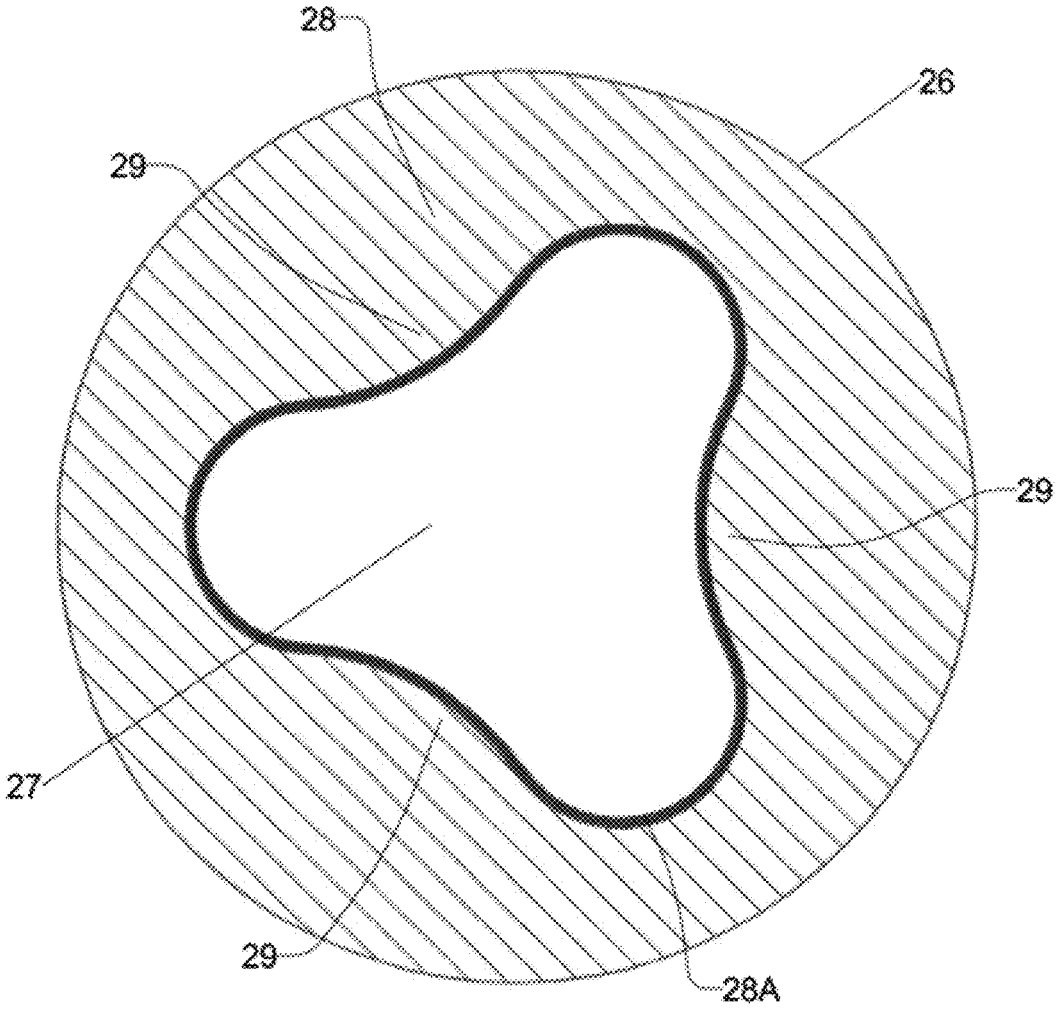
FIG. 2C is a view taken in section along the line 2C-2C of FIG. 2B.

Section 26 with longitudinally-extending integrated centralizing features 28 as shown, for example, in FIG. 2B can be described as providing a bore which is non-round in cross-section. Radially innermost areas on the bore wall (corresponding to the inward ends of centralizing features 28) provide support for an electronics package 22 or other downhole probe either by bearing directly on a wall of the probe or on a vibration damping layer between the probe and the support areas. The support areas are spaced circumferentially around the probe. Between neighboring circumferentially-spaced support areas the bore wall follows a path that is radially spaced apart from the outer surface of the probe to provide channels extending generally longitudinally in section 26. Drilling fluid or other fluid in bore 27 can flow past the probe in these channels. In such embodiments, section 26 may have a cylindrical outer wall and the wall thickness of section 26 may vary. The wall thickness may be relatively large at locations corresponding to centralizing features 28 and may be relatively small at locations corresponding to valleys 31 running between circumferentially-adjacent centralizing features 28.

A damping layer may be provided by applying a coating or otherwise applying a layer to the downhole probe and/or centralizing features 28. A damping layer may also be provided as a separate component that extends along the probe and is located between the probe and centralizing features 28. It is not mandatory that the damping layer be bonded or otherwise adhered to either of the downhole probe or centralizing features 28. For example, a damping layer may be provided in the form of a tubular structure that extends around the downhole probe and is compressed between centralizing features 28 and the surface of the downhole probe. Such a damping layer may be made, for example by injection molding or extrusion. Such a damping layer may follow the profile of the wall of bore 27 (including centralizing features 28) or may follow the profile of the outside of the downhole probe. The damping layer may be removable from within section 26 without drilling, heating or burning it out. Rotational movement of the damping layer, if not bonded to the inner surface of section 26, may be restricted by centralizing features 28.

Figure 4:
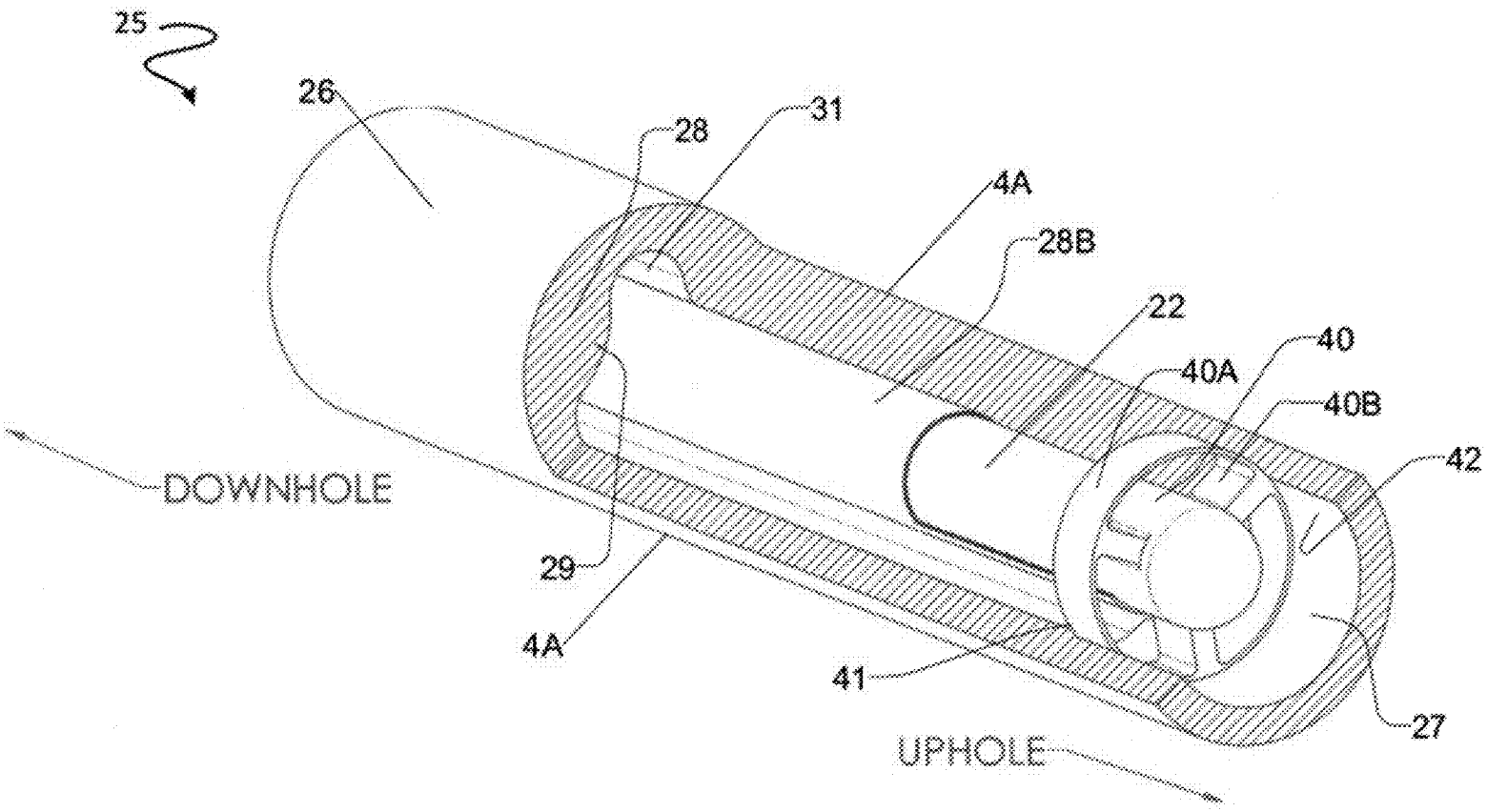
FIG. 4 is a perspective cutaway view of a downhole assembly containing an electronics package according to another embodiment of the invention.
Figure 4A:
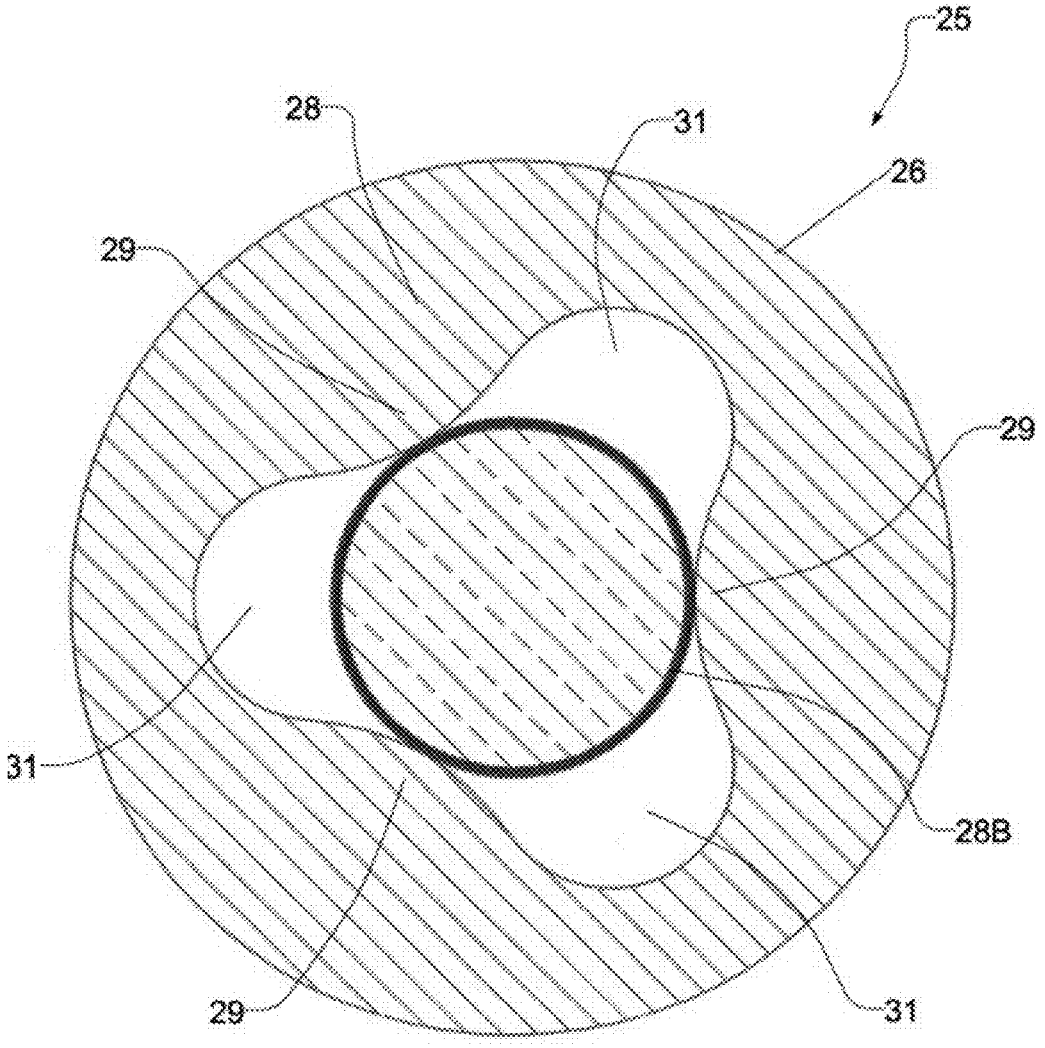
FIG. 4A is a view taken in section along the line 4A-4A of FIG. 4.

It is beneficial for electronics package 22 to sit between the innermost points of centralizing features 28 with a size-on-size fit (e.g. a transition fit or tight tolerance sliding fit) or a slight interference fit. Rotational movement of the damping layer may also be restricted by the pinching effect between centralizing features 28 and electronics package 22 caused by the size-on-size fit. FIGS. 2 and 2A show a damping layer 28A between centralizing feature 28 and electronics package 22. FIGS. 4 and 4A show a damping layer 28B on the outer surface of electronics package 22.

Providing a structure in which the material of section 28 extends to support electronics package 22 with a fit having little, if any clearance provides good mechanical coupling between electronics package 22 and section 26. As section 26 is typically very massive and rigid compared to electronics package 22, this tight mechanical coupling helps to prevent electronics package from vibrating in modes having lower frequencies. Downhole locations can be subject to high amplitude low frequency vibrations. The tight coupling of electronics package 22 to section 26 can significantly reduce the vibrations of electronics package 22. Mechanically coupling electronics package 22 to section 26 continuously along its length can substantially reduce flexing and vibration of electronics package 22 caused by lateral accelerations of the drill string, flow of drilling fluid, or the like.

Figure 5:
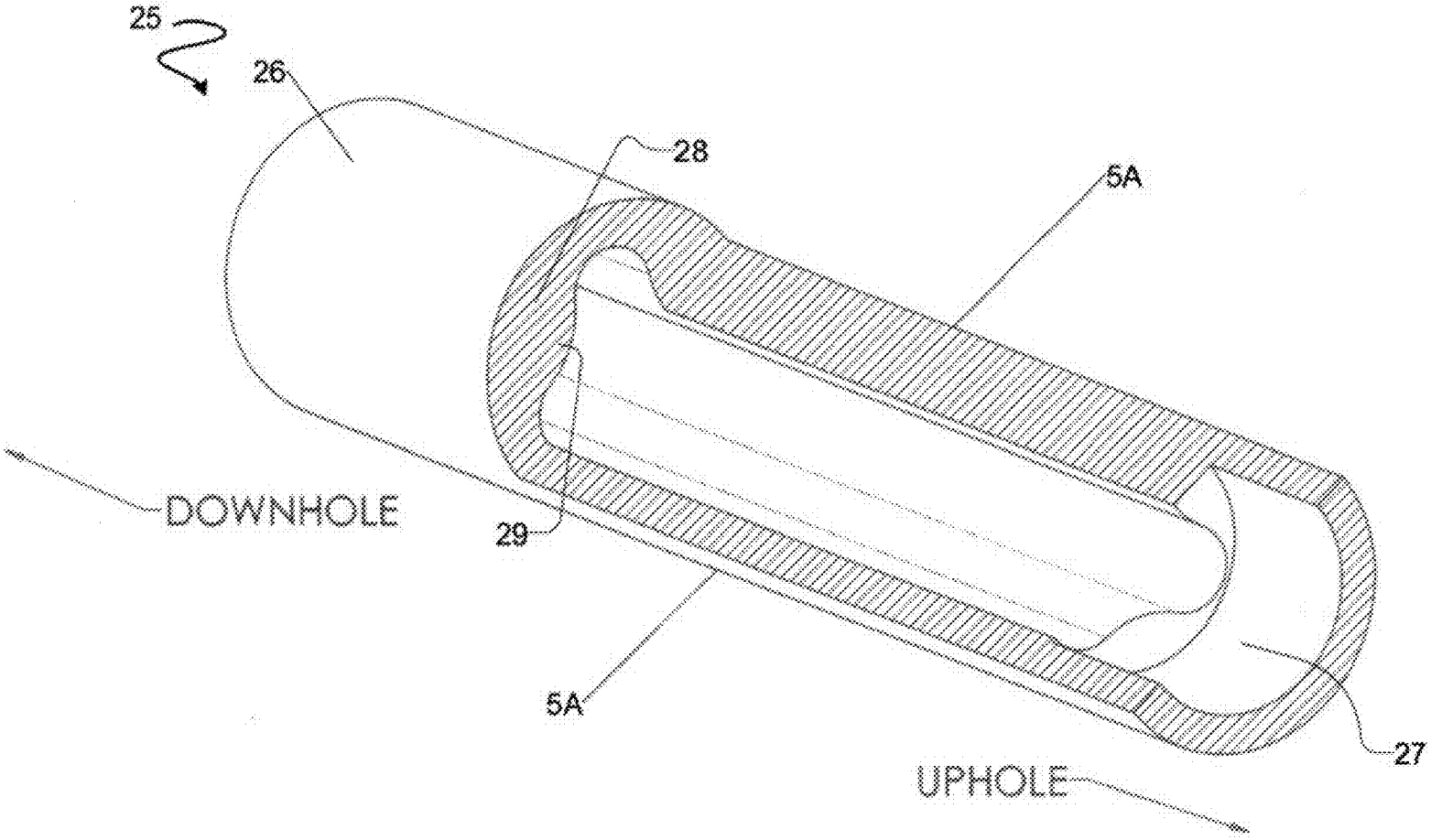
FIG. 5 is a perspective cutaway view of the downhole assembly of FIG. 4 without an electronics package.
Figure 5A:
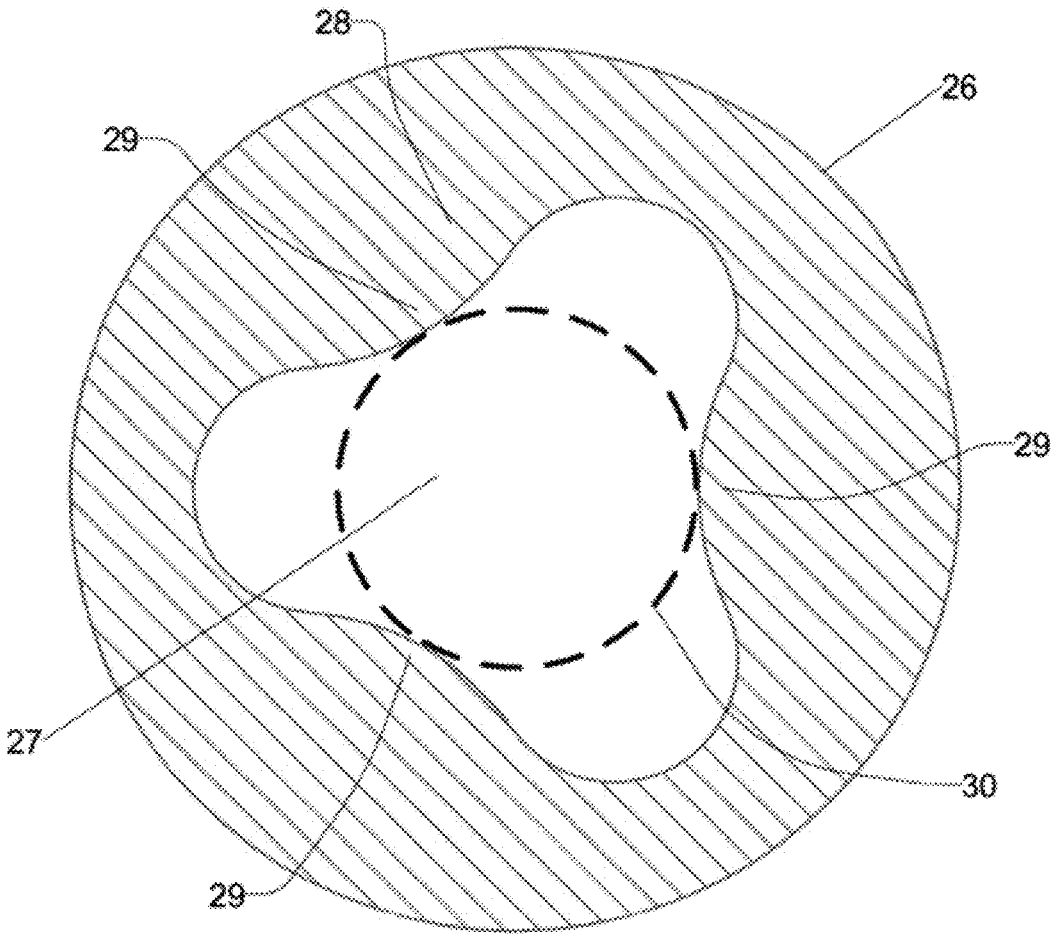
FIG. 5A is a view taken in section along the line 5A-5A of FIG. 5.

In the illustrated embodiment, centralizing features 28 comprise ridges 29 that extend longitudinally within bore 27. As shown in FIG. 5A, the innermost points of ridges 29 lie on a circle 30 that defines a centralized location for electronics package 22. Valleys 31 between ridges 29 provide channels within which drilling fluid or other fluids can flow through bore 27 past electronics package 22.

Ridges 29 and/or other centralizing features 28 may extend to support any desired part of electronics package 22. Ridges 29 may be interrupted or continuous. In some embodiments, ridges 29 extend to support electronics package 22 substantially continuously along at least 60% or 70% or 80% of an unsupported portion of electronics package 22 (e.g. a portion of electronics package 22 extending from a point at which electronics package 22 is coupled to section 26 to an end of electronics package 22). In some embodiments centralizer 28 engages substantially all of the unsupported portion of electronics package 22. Here, 'substantially all' means at least 95%. In some embodiments, ridges 29 extend to support electronics package 22 for substantially the full length of electronics package 22.

In the illustrated embodiment, ridges 29 take the form of rounded lobes that extend longitudinally within bore 27. Such lobes may be formed, for example, by hobbing. Rounded lobes as shown advantageously do not provide sharp corners at which cracks could have an increased tendency to occur.

Figure 6:
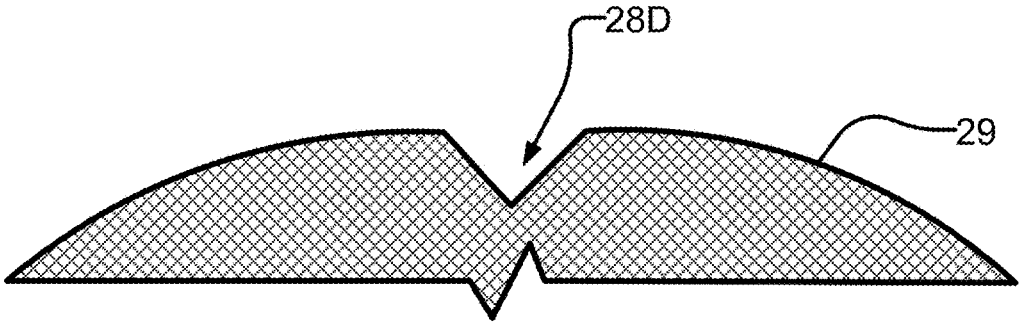
FIG. 6 is a schematic illustration of centralizing ridges which comprise V-grooves, according to one embodiment of the invention.

In the illustrated embodiment, electronics package 22 is supported by three ridges 29. However, other embodiments may have more or fewer ridges. For example, some alternative embodiments have 3 to 8 ridges 29. The configuration of the innermost parts of ridges 29 that interface to electronics package 22 may be varied. In the illustrated embodiment, ridges 29 present gently-curved inwardly-convex surfaces to electronics package 22. In other embodiments, the innermost ends of ridges 29 may be formed to provide V-grooves 28D (as shown schematically in FIG. 6) to receive electronics package 22 or may have other shapes such as channels that conform to the outer surface of electronics package 22.

It is convenient but not mandatory to make centralizing features 28 symmetrical to one another. It is also convenient but not mandatory to make the cross-section of section 26, including centralizing features 28 mirror symmetrical about an axis passing through one of ridges 29. It is convenient but not mandatory for ridges 29 to extend parallel to the longitudinal axis of section 26. In the alternative, centralizer ridges 29 may be formed to spiral helically around the inner wall of bore 27 (like rifling in a rifle barrel). Where centralizing features 28 are in the form of helical ridges, as few as two ridges 29 that spiral around the bore of section 26 may be provided. In other embodiments centralizing features 28 are configured to provide 3 to 8 helical ridges that spiral about the bore of section 26.

As noted above, a layer of a vibration damping material such as rubber, an elastomer, a thermoplastic or the like may be provided between electronics package 22 and centralizing features 28. The vibration damping material may assist in preventing 'pinging' (high frequency vibrations of electronics package 22 resulting from shocks). The vibration damping material may, for example, comprise a layer or coating of rubber, a suitable plastic or the like. In some applications it is advantageous for electronics package 22 to be electrically insulated from section 26. For example, where electronics package 22 comprises an EM telemetry system, it may be necessary to electrically isolate parts of the housing of electronics package 22 from parts of section 26 (which may comprise a gap sub). In such applications, the vibration damping material may also be an electrical insulator.

Where the section comprises a gap sub, the gap sub may have an electrically-conducting uphole part, an electrically-conducting downhole part and an electrically insulating part between the uphole and downhole parts. The downhole probe may extend across the electrically insulating part of the gap sub. Centralizing features as described herein may be provided on both the uphole and downhole parts of the gap sub. The centralizing features may comprise, for example, longitudinally-extending ridges extending radially-inwardly into the bore in both the uphole and downhole parts of the gap sub. The ridges may be interrupted at the gap.

Electronics package 22 may be locked against axial movement within bore 27 in any suitable manner. This may be done, for example, by way of pins, bolts, clamps, or other suitable fasteners. In the embodiment illustrated in FIG. 2, a spider 40 having a rim 40A supported by arms 40B is attached to electronics package 22. Rim 40A engages a ledge or step 41 formed at the end of a counterbore within bore 27. Rim 40A is clamped tightly against ledge 41 by a nut (not shown) that engages internal threads (not shown) on surface 42.

In some embodiments, centralizing features 28 (such as ridges 29) extend along electronics package 22 from spider 40 or other longitudinal support system for electronics package 22 continuously to the opposing end of electronics package 22. In other embodiments one or more sections of centralizing features 28 extend to grip electronics package 22 over at least 70% or at least 80% or at least 90% or at least 95% of a distance from the longitudinal support to the opposing end of electronics package 22.

In some embodiments electronics package 22 has a fixed rotational orientation relative to section 26. For example, in some embodiments spider 40 is keyed, splined, has a shaped bore that engages a shaped shaft on the electronics package 22 or is otherwise non-rotationally mounted to electronics package 22. Spider 40 may also be non-rotationally mounted to section 26, for example by way of a key, splines, shaping of the face or edge of rim 40A that engages corresponding shaping within bore 27 or the like.

In some embodiments electronics package 22 has two or more spiders, electrodes, or other elements that directly engage section 26. For example, electronics package 22 may include an EM telemetry system that has two spaced apart electrical contacts 50 (see e.g. FIG. 3) that engage section 26. In such embodiments, centralizing features 28 may extend for a substantial portion of (e.g. at least 50% or at least 65% or at least 75% or at least 80% or substantially the full length of) electronics package 22 between two elements that engage section 26.

Figure 3:
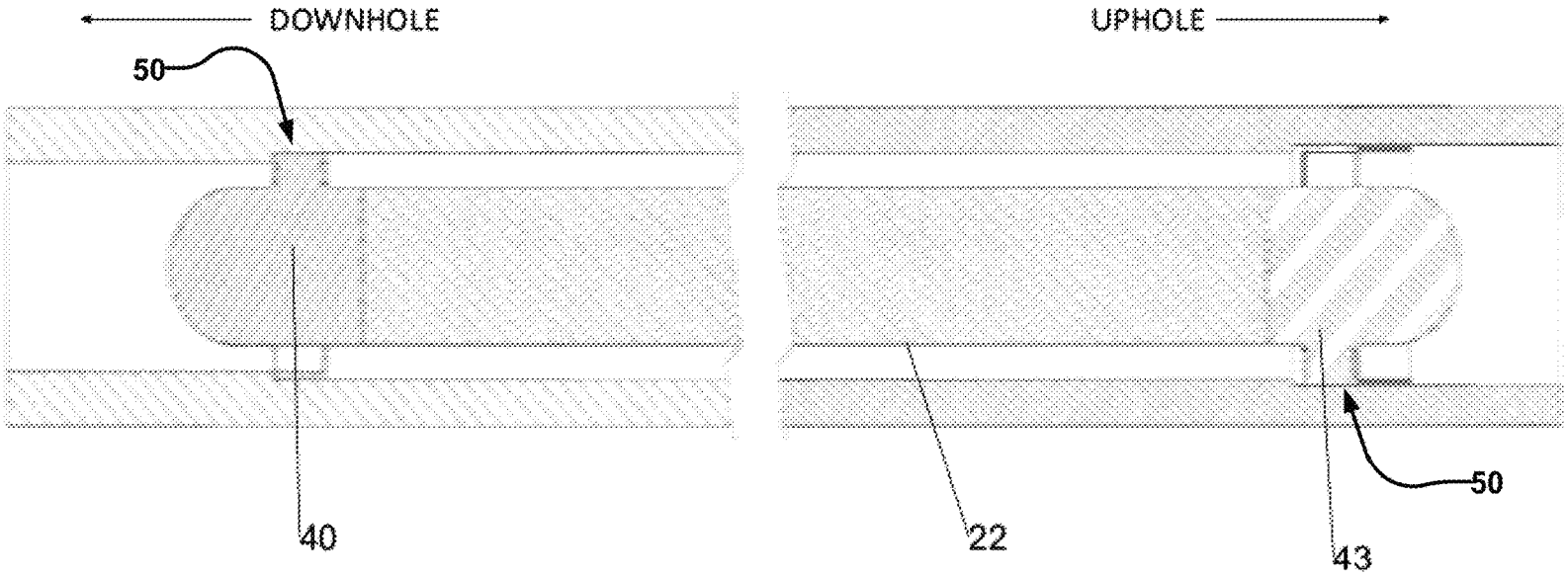
FIG. 3 is a schematic illustration of one embodiment of the invention where an electronic package is supported between two spiders.

In an example embodiment shown in FIG. 3, electronics package 22 is supported between two spiders 40 and 43. Each spider 40 and 43 engages a corresponding landing ledge within bore 27. Each spider 40 and 43 may be non-rotationally coupled to both electronics package 22 and bore 27. Centralizing features 28 may be provided between spiders 40 and 43. Optionally spiders 40 and 43 are each spaced longitudinally apart from the ends of centralizing features 28 by a short distance (e.g. up to about ½ meter (18 inches) or so) to encourage laminar flow of drilling fluid.

In some embodiments centralising ridges extend longitudinally along a part of the section between first and second landings and the downhole probe is configured to engage the first and second landings (for example, by way of spiders or other coupling mechanisms). The centralising ridges may extend along at least 60%, at least 70%, at least 80%, at least 90% or substantially all of the distance between the first and second landings.

Figure 7:
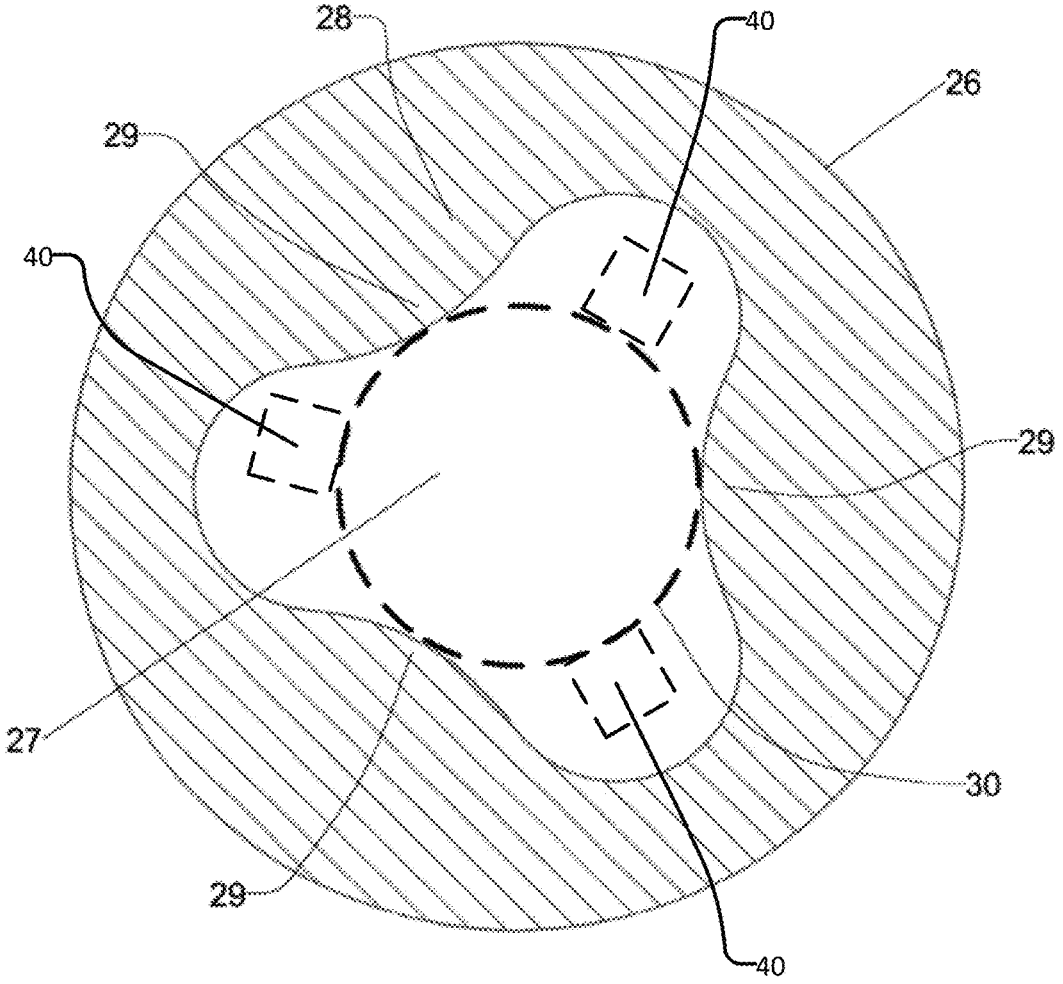
FIG. 7 is a schematic illustration of an electronics package with projecting features, according to one embodiment of the invention.

Centralizing features as described herein may optionally interface non-rotationally to an electronics package 22. For example, the electronics package 22 may have features 40 that project to engage between inwardly-projecting ridges 29, as shown schematically in FIG. 7, so that the centralizing features prevent rotation of electronics package 22 and/or provide enhanced damping of torsional vibrations of electronics package 22.

In some applications, as drilling progresses, the outer diameter of components of the drill string may change. For example, a well bore may be stepped such that the wellbore is larger in diameter near the surface than it is in its deeper portions. At different stages of drilling a single hole, it may be desirable to install the same downhole probe in drill string sections having different dimensions. A set of sections 26 of different diameters may be provided. All of the sections 26 in the set may have centralizing features 28 dimensioned to receive the same electronics package 22 (or other downhole probe). The set of sections 26 as described herein may be provided at a well site.

Moving a downhole probe or other electronics package into a drill string section 26 of a different size may be easily performed at a well site by removing the electronics package from one drill string section, changing a spider or other longitudinal holding device to a size appropriate for the new drill string section 26 and inserting the electronics package into new drill string section 26.

For example, a set may be provided comprising: drill string sections of different sizes all having centralizing features as described herein to support the same downhole probe. Where the different drill string sections have different bore sizes the set may additionally include spiders or other longitudinal holding devices of different sizes suitable for use with the supplied drill string sections. The set may, by way of non-limiting example, comprise drill string sections of a plurality of different standard outside diameters such as outside diameters of two or more of: 4¾ inches, 6½ inches, 8 inches, 9½ inches and 11 inches together with spiders or other mechanisms for longitudinally anchoring a probe in the different drill string sections. The centralizing features in the drill string sections may, by way of non-limiting example, be dimensioned in length to support a probe having a length in the range of 2 to 20 meters.

Embodiments as described above may provide one or more of the following advantages. Centralizing features 28 may extend for the full length of the electronics package 22 or any desired part of that length. Especially where centralizing features 28 support electronics package 22 from four or more sides, electronics package 22 is mechanically coupled to section 26 in all directions, thereby reducing the possibility for localized bending of the electronics package 22 under severe shock and vibration. Reducing local bending of electronics package 22 can facilitate longevity of mechanical and electrical components and reduce the possibility of catastrophic failure of the housing of electronics assembly 22 or other components internal to electronics package 22 due to fatigue. Good mechanical coupling of electronics package 22 to section 26 helps to raise the resonant frequencies of electronics package 22 and alleviate damage to components resulting from 'pinging' (excitation of vibrations by shocks). Centralizer 28 can accommodate slick electronics packages 22 and can allow an electronics package 22 to be removable while downhole (since centralizing features 28 can be made so that they do not interfere with withdrawal of an electronics package 22 in a longitudinal direction). Centralizer 28 can counteract gravitational sag and maintain electronics package 22 central in bore 27 during directional drilling or other applications where bore 27 is horizontal or otherwise non-vertical.

One example application of apparatus as described herein is directional drilling. In directional drilling the section of a drill string containing a downhole probe may be non-vertical. A centralizer as described herein can maintain the downhole probe centered in the drill string against gravitational sag, thereby maintaining sensors in the downhole probe true to the bore of the drill string.

Apparatus as described herein may be applied in a wide range of subsurface drilling applications. For example, the apparatus may be applied to support downhole electronics that provide telemetry in logging while drilling ('LWD') and/or measuring while drilling ('MWD') telemetry applications. The described apparatus is not limited to use in these contexts, however.

A wide range of alternatives are possible. For example, it is not mandatory that section 26 be a single component. In some embodiments section 26 comprises a plurality of components that are assembled together into the drill string (e.g. a plurality of drill collars).

INTERPRETATION OF TERMS

Unless the context clearly requires otherwise, throughout the description and the

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an" and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with and made of a material that is same as a material of the drill string section; and wherein the centralizing features comprise a plurality of ridges circumferentially spaced apart around a periphery of the bore and extending longitudinally within the bore.

2. A downhole assembly according to claim 1 wherein the section comprises a plurality of components coupled together.

3. A downhole assembly according to claim 1 wherein the section comprises a plurality of collars coupled together by threaded couplings.

4. A downhole assembly according to claim 1 wherein the section has a cylindrical outer wall.

5. A downhole assembly according to claim 1 wherein the probe has a fixed rotational orientation relative to the section.

6. A downhole assembly according to claim 1 wherein the ridges extend parallel to a longitudinal centerline of the bore.

7. A downhole assembly according to claim 1 wherein the ridges are equally spaced apart from one another around the circumference of the bore.

8. A downhole assembly according to claim 1 wherein the plurality of ridges comprise two to eight ridges.

9. A downhole assembly according to claim 1 wherein the ridges are provided by two ridges on opposite sides of the bore.

10. A downhole assembly according to claim 1 wherein, in transverse cross-section, the ridges are mirror symmetrical about a plane passing through and coplanar with a longitudinal centerline of the centralizer.

11. A downhole assembly according to claim 1 wherein, in a transverse cross-section of the section the ridges have profiles in the form of rounded lobes.

12. A centralizer according to claim 11 wherein each of the rounded lobes is mirror symmetrical about a plane passing through and coplanar with a longitudinal centerline of the bore.

13. A downhole assembly according to claim 1 wherein portions of the centralizing features that contact the downhole probe are formed to conform to a shape of an outer surface of the downhole probe.

14. A downhole assembly according to claim 1 wherein, in transverse cross-section, the centralizing features are mirror symmetrical about a plane passing through and coplanar with a longitudinal centerline of the centralizer.

15. A downhole assembly according to claim 1 wherein the downhole probe comprises an electronics package.

16. A downhole assembly according to claim 1 wherein the downhole probe comprises a metal housing and the metal housing is harder than the material of the centralizing features.

17. A downhole assembly according to claim 1 wherein the downhole probe comprises a cylindrical housing.

18. A downhole assembly according to claim 1 wherein the downhole probe has a length of less than 20 meters.

19. A downhole assembly according to claim 1 wherein the section comprises a landing adjacent an uphole or downhole end of the ridges and the downhole probe is configured to engage the landing.

20. A downhole assembly according to claim 19 wherein the landing comprises a step in the bore of the section.

21. A downhole assembly according to claim 20 wherein the downhole probe comprises a spider configured to engage the landing.

22. A downhole assembly according to claim 21 wherein the spider is non-rotationally mounted to both the probe and the drill string section.

23. A downhole assembly according to claim 21 wherein the spider is spaced longitudinally apart from the centralizing features.

24. A downhole assembly according to claim 1 wherein the ridges extend longitudinally along a part of the section between first and second landings and the downhole probe is configured to engage the first and second landings.

25. A downhole assembly according to claim 24 wherein the ridges extend along at least 60% of the distance between the first and second landings.

26. A downhole assembly according to claim 25 wherein the ridges extend substantially continuously to support the downhole probe over at least 60% of the distance between the first and second landings.

27. A downhole assembly according to claim 1 comprising an uphole coupling at an uphole end of the drill string section and a downhole coupling at a downhole end of the drill string section.

28. A downhole assembly according to claim 27 wherein the uphole and downhole couplings comprise threaded couplings.

29. A downhole assembly according to claim 1 wherein the downhole probe has a resonant frequency f when the downhole probe is not engaged in the drill string section and the resonant frequency of the down hole probe is increased to $f'>f$ as a result of mechanical coupling between the downhole probe and the drill string section when the probe is engaged between the centralizing features.

30. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with the section;

wherein the centralizing features comprise a plurality of ridges circumferentially spaced apart around a periphery of the bore and extending longitudinally within the bore; and wherein the probe comprises projecting features that project to engage between the plurality of ridges.

31. A downhole assembly according to claim 30 wherein the projecting features are configured to prevent rotation of the downhole probe relative to the section.

32. A downhole assembly according to claim 31 wherein the projecting features are configured to damp torsional vibrations of the downhole probe.

33. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with the section; and wherein portions of the centralizing features that contact the downhole probe comprise V-grooves extending longitudinally within the bore.

34. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with and made of a material that is same as a material of the drill string section; and a layer of a vibration damping material between the centralizing features and the downhole probe.

35. A downhole assembly according to claim 34 wherein the vibration damping material comprises a layer attached to the centralizing features.

36. A downhole assembly according to claim 35 wherein the layer extends circumferentially around the bore wall of the bore.

37. A downhole assembly according to claim 34 wherein the vibration damping material comprises a layer attached to the downhole probe.

38. A downhole assembly according to claim 34 wherein a hardness of the vibration damping material is less than a hardness of an outer surface of the downhole probe and less than a hardness of the centralizing features.

39. A downhole assembly according to claim 34 wherein the vibration damping material is electrically insulating.

40. A downhole assembly according to claim 39 wherein the downhole probe comprises an electromagnetic telemetry system.

41. A downhole assembly according to claim 40 wherein the downhole probe comprises two spaced apart electrical contacts that engage the section.

42. A downhole assembly according to claim 34 wherein the vibration damping material comprises rubber, a plastic, a thermoplastic, or an elastomer.

43. A downhole assembly according to claim 34 wherein the vibration damping material comprises a pre-formed sleeve.

44. A downhole assembly according to claim 43 wherein the sleeve is slidably removable from the probe.

45. A downhole assembly according to claim 43 wherein the sleeve is extruded or injection molded.

46. A downhole assembly according to claim 43 wherein the sleeve is configured to engage the centralizing features, the engagement limiting rotation of the sleeve relative to the drill string section.

47. A downhole assembly according to claim 34 wherein the vibration damping material is applied as a coating to the centralizing features.

48. A downhole assembly according to claim 34 wherein the vibration damping material is applied as a coating to the downhole probe.

49. A downhole assembly according claim 34 wherein the downhole probe and layer of vibration damping material are an interference fit between the centralizing features.

50. A downhole assembly according to claim 34 wherein the downhole probe and layer of vibration damping material are a tight sliding fit between the centralizing features.

51. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with and made of a material that is same as a material of the drill string section; and wherein the centralizing features extend to support the downhole probe substantially continuously along at least 60% of a length of the downhole probe.

52. A downhole assembly according to claim 51 wherein the centralizing features extend to support the downhole probe substantially continuously along at least 80% of a length of the downhole probe.

53. A downhole assembly according to claim 51 wherein the centralizing features extend to support the downhole probe substantially continuously along substantially all of the length of the downhole probe.

54. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with and made of a material that is same as a material of the drill string section; and wherein the centralizing features support the downhole probe over at least 70% of the downhole probe.

55. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with and made of a material that is same as a material of the drill string section; and wherein the downhole probe is an interference fit between the centralizing features.

56. A downhole assembly comprising:

a drill string section having a bore extending longitudinally through the drill string section and a downhole probe located in the bore of the section;

wherein the drill string section comprises centralizing features extending inwardly from a wall of the bore, the centralizing features supporting the downhole probe in the bore and the centralizing features are arranged to provide passages for the flow of drilling fluid around an outside of the downhole probe between the centralizing features;

wherein the centralizing features are integral with and made of a material that is same as a material of the drill string section; and wherein the downhole probe is a tight sliding fit between the centralizing features.

* * * * *